US008879969B2

(12) United States Patent
Shikama et al.

(10) Patent No.: US 8,879,969 B2
(45) Date of Patent: Nov. 4, 2014

(54) IMAGE FORMING APPARATUS INCLUDING IMAGE FORMING CALIBRATION

(71) Applicants: Takeshi Shikama, Osaka (JP); Masayuki Hayashi, Osaka (JP); Kunihiro Komai, Osaka (JP); Tatsuya Miyadera, Osaka (JP); Motohiro Kawanabe, Osaka (JP); Yoshinori Shirasaki, Osaka (JP); Hiroaki Ikeda, Osaka (JP); Akinori Yamaguchi, Osaka (JP); Takuhei Yokoyama, Osaka (JP)

(72) Inventors: Takeshi Shikama, Osaka (JP); Masayuki Hayashi, Osaka (JP); Kunihiro Komai, Osaka (JP); Tatsuya Miyadera, Osaka (JP); Motohiro Kawanabe, Osaka (JP); Yoshinori Shirasaki, Osaka (JP); Hiroaki Ikeda, Osaka (JP); Akinori Yamaguchi, Osaka (JP); Takuhei Yokoyama, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/644,172

(22) Filed: Oct. 3, 2012

(65) Prior Publication Data

US 2013/0084109 A1 Apr. 4, 2013

(30) Foreign Application Priority Data

Oct. 4, 2011 (JP) ..... 2011-220432

(51) Int. Cl.
*G03G 15/01* (2006.01)
*G03G 15/00* (2006.01)

(52) U.S. Cl.
CPC ..... *G03G 15/0194* (2013.01); *G03G 15/5058* (2013.01); *G03G 2215/0141* (2013.01); *G03G 2215/0161* (2013.01)
USPC ..... 399/301; 399/40; 399/72

(58) Field of Classification Search
USPC ..... 347/116, 19; 399/301, 49
See application file for complete search history.

(56) References Cited

U.S. PATENT DOCUMENTS

| | | | | |
|---|---|---|---|---|
| 6,603,495 | B2 * | 8/2003 | Hayakawa | 347/116 |
| 6,871,029 | B2 * | 3/2005 | Brewington et al. | 399/27 |
| 6,920,303 | B2 * | 7/2005 | Yamanaka et al. | 399/301 |
| 2008/0181635 | A1 * | 7/2008 | Hamahashi | 399/40 |
| 2009/0290884 | A1 * | 11/2009 | Omoya | 399/27 |
| 2010/0178083 | A1 * | 7/2010 | Lee | 399/301 |

FOREIGN PATENT DOCUMENTS

| | | |
|---|---|---|
| JP | 11-65208 | 3/1999 |

* cited by examiner

*Primary Examiner* — Walter L Lindsay, Jr.
*Assistant Examiner* — Arlene Heredia Ocasio
(74) *Attorney, Agent, or Firm* — Oblon, Spivak, McClelland, Maier & Neustadt, L.L.P.

(57) ABSTRACT

An image forming apparatus can transfer a plurality of color component images onto a surface of a recording medium to form an image on the recording medium. The image forming apparatus includes a pattern generation part to generate information about an alignment pattern to be used for a calibration of an image forming, a plurality of stations each including a photosensitive drum to form an alignment pattern corresponding to each of a plurality of color components onto a carry belt or the recording medium, and a read part to detect a plurality of alignment patterns formed by the plurality of stations.

16 Claims, 6 Drawing Sheets

(a)

(b)

(c)

IMAGE FORMING APPARATUS INCLUDING IMAGE FORMING CALIBRATION

CROSS-REFERENCE TO RELATED APPLICATIONS

The present application claims priority to and incorporates by reference the entire contents of Japanese Patent Application No. 2011-220432 filed in Japan on Oct. 4, 2011.

BACKGROUND OF THE INVENTION

1. Field of the Invention

The present invention relates to an image forming apparatus.

2. Description of the Related Art

There is known an image forming apparatus in which four photosensitive drums are used for each of four colors, in order to transfer overlappingly four toner images each comprising each of four colors onto a recording medium and thereby form a color image on the recording medium. In this type of image forming apparatus, there is known a technique to prevent a misregistration (color drift) among toner images by forming calibration patterns for respective colors on a carry belt while each photosensitive drum rotates one round and detecting each of the formed calibration patterns to calibrate the misregistration.

Japanese Patent Application Laid-open No. H11-65208 discloses a technique to improve the accuracy in detecting the misregistration by forming a plurality of toner marks (patterns) and detecting the plurality of toner marks in a color image forming apparatus.

Recently, there is a need for an image forming apparatus in which five or more photosensitive drums are used for each of multiple colors (five or more) so that toner images each comprising each of multiple colors are transferred overlappingly onto a surface of the recording medium, in order to obtain a high quality image. In this type of multi-color image forming apparatus, the number of calibration patterns formed on the carry belt while each photosensitive drum rotates one round increases, since calibration patterns for each color are formed on the carry belt when calibrating the misregistration.

In the technique disclosed by Japanese Patent Application Laid-open No. H11-65208, since a plurality of toner marks are formed for each color, the number of toner marks increases in a case that a color image is formed by means of five or more photosensitive drums each corresponding to each of five or more colors, in comparison with a case that a color image is formed by means of four photosensitive drums each corresponding to each of four colors. Therefore, an interval between toner marks is shortened and the accuracy in detecting the toner mark may be lowered.

SUMMARY OF THE INVENTION

It is an object of the present invention to at least partially solve the problems in the conventional technology.

An image forming apparatus capable of transferring a plurality of color component images onto a surface of a recording medium to form an image on the recording medium, includes a pattern generation part to generate information about an alignment pattern to be used for a calibration of an image forming, a plurality of stations each including a photosensitive drum to form an alignment pattern corresponding to each of a plurality of color components onto a carry belt or the recording medium, and a read part to detect a plurality of alignment patterns formed by the plurality of stations. The pattern generation part generates the information about the alignment pattern on the basis of the number of stations for one or more colors to be used for the image forming, the plurality of stations generate a pattern group including the plurality of alignment patterns on the basis of the information about the alignment pattern, a length of the pattern group in a sub-scanning direction is a length obtained by multiplying 1/N by a perimeter of the photosensitive drum, and N is a natural number starting from 1.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is now explained in detail with reference to an image forming apparatus capable of calibrating a misregistration (color drift) when forming a color image by detecting information about positions of calibration patterns. The present invention can be applied not only to image forming apparatus but also to any of printer, scanner, copying machine, fax machine and so on, insofar as it calibrates a misregistration of an image to be formed.

(Configuration of Image Forming Apparatus)

Figure 1:
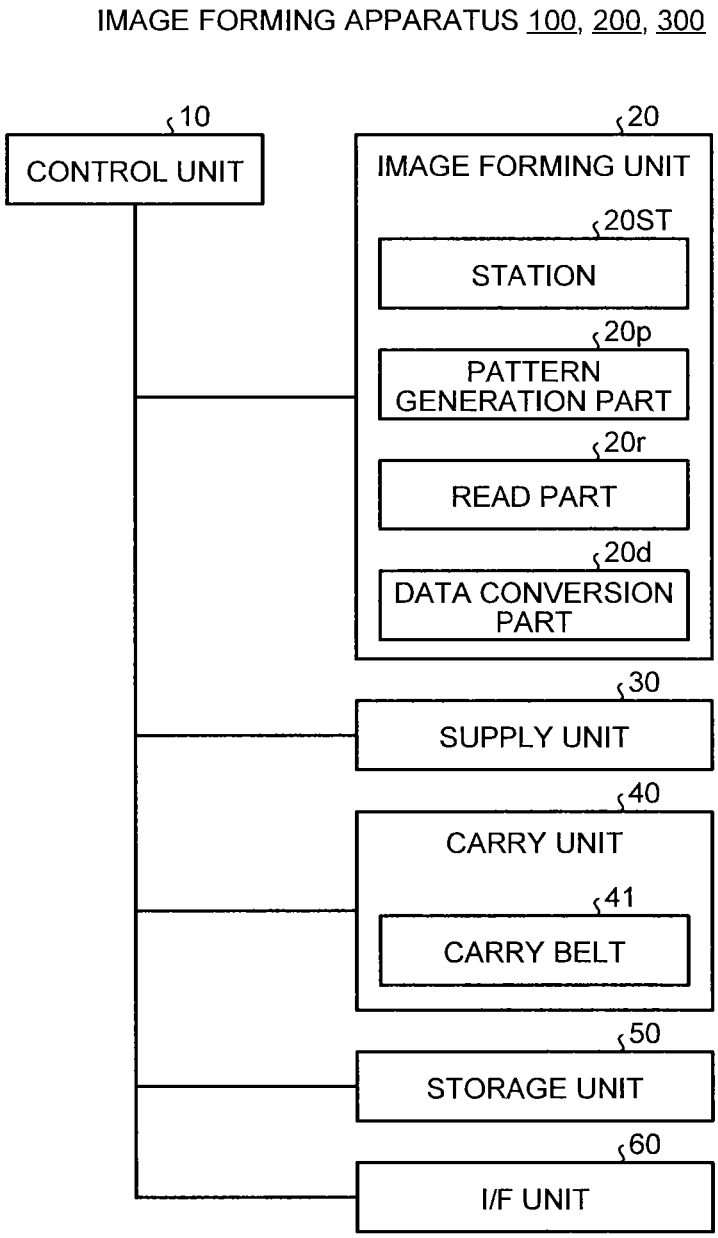
FIG. 1 is a block diagram illustrating a basic configuration of an image forming apparatus.

FIG. 1 illustrates an example of basic configuration of an image forming apparatus according to a present embodiment.

In FIG. 1, an image forming apparatus 100 includes a control unit 10, an image forming unit 20, a supply unit 30, a carry unit 40, a storage unit 50, and an I/F unit 60.

The control unit 10 instructs each unit of the image forming apparatus 100 about their operations and controls their operations. In the present embodiment, the control unit 10 includes a print job management part to control a sequence of forming images and a CTL (controller) to output information about an image forming to each unit of the image forming apparatus 100.

The image forming unit 20 transfers a toner image (color component image) on a surface of a recording medium to form an image on the recording medium. In the present embodiment, the image forming unit 20 includes a plurality of stations 20ST each corresponding to each of multiple colors (black, yellow, cyan, magenta, green, and red). Each toner image is developed on a surface of a photosensitive drum included in each color station 20ST. Then, the image forming unit 20 transfers a plurality of toner images each developed on each of a plurality of photosensitive drums onto a surface of the recording medium. At this time, the image forming unit 20 transfers toner images of each color on photosensitive drums of each color onto the surface of the recording medium so that toner images are overlapped with each other and thereby a color image is formed on the recording medium. The detail operation of forming an image will be described in the following (Operation of Forming Image).

When a calibration is performed during start-up and operation of the image forming apparatus 100, the image forming unit 20 outputs information about calibration patterns generated by each pattern generation part 20*p* to each color station 20ST. At this time, each color station 20ST transfers calibration patterns onto a surface of a carry belt 41 of the carry unit 40, so that a calibration color image is formed on the carry belt 41.

The image forming apparatus 100 detects at a reading part 20*s* information about positions of calibration patterns (hereinafter this information is called positional information) in the calibration color image on the carry belt 41. Thereby, on the basis of the detected positional information, the image forming apparatus 100 calibrates the color drift involved when an image is formed by overlapping toner images of each color (hereinafter, this color drift is called misregistration). In the present embodiment, the image forming unit 20 can use alignment patterns (FIG. 5) as calibration patterns. The detail operations of calibrating the image forming will be described in the following (Operation of Calibrating Image Forming).

In the following explanations, each color station includes a set of a photosensitive drum corresponding to a color, a charger, an exposure device, a developing device, a transferring device and a neutralizing device. Therefore, the image forming unit 20 is provided with color stations each corresponding to each of multiple colors. In the following explanations, the components represented by reference numerals accompanying symbols BK, Y, C, M, G, and R correspond to respective colors (black, yellow, cyan, magenta, green, and red).

Next, the supply unit 30 in FIG. 1 loads and stores the recording medium on which any image has not been formed in a supply tray or the like. Under the control of the control unit 10, the supply unit 30 supplies the recording medium by means of a supply roller or the like. As the recording medium, plain paper, quality paper, thin paper, heavy paper, OHP sheet, synthetic resin film, metal thin film and the like can be used.

Under the control of the control unit 10, the carry unit 40 carries or transports the recording medium to the image forming unit 20 by means of the carry belt 41. The carry unit 40 ejects the recording medium on which the image has been formed and which has been then subjected to a predetermined treatment. The predetermined treatment may be a fixing treatment of the image (toner, ink and so on) on the recording medium, as well as a stapling treatment, a binding treatment and a sorting treatment of a plurality of recording medium.

The storage unit 50 stores information about the image to be formed. The storage unit 50 also stores information about operation status of the image forming apparatus 100, during stand-by mode or operation of the image forming apparatus 100.

The I/F unit 60 performs an input and output of information (signal) between the image forming apparatus 100 and the outside. The I/F unit 60 includes a computer interface part and a user interface part. The computer interface part performs a communication of the information about the image forming with a PC or the like outside of the image forming apparatus 100. The user interface part performs an input or the like of information about the recording medium and conditions for the image forming by the user of the image forming apparatus 100, as well as an output or the like of information about status of the image forming apparatus and conditions for the image forming to the user.

(Function of Image Forming Apparatus)

Figure 2:
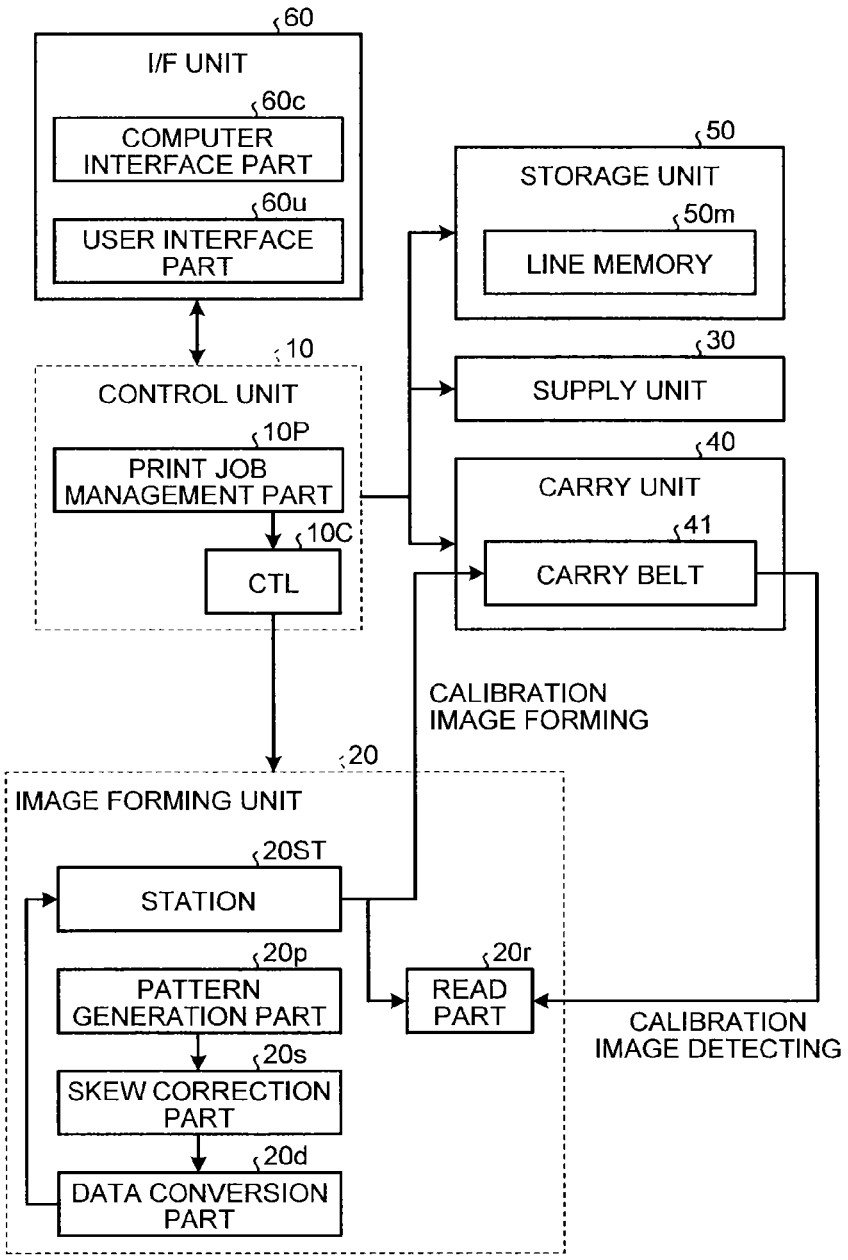
FIG. 2 is a functional block diagram of an image forming apparatus.

FIG. 2 illustrates functional blocks of the image forming apparatus according to the present embodiment.

In FIG. 2, the image forming apparatus obtains the information about the image forming (information about the image to be formed and the information about start of the image forming) through the computer interface part 60*c* and the user interface part 60*u* of the I/F unit 60. At this time, the image forming apparatus outputs the obtained information to the control unit 10.

The print job management part 10P of the control unit 10 controls the sequence of forming images, on the basis of the information about start of the image forming. The print job management part 10P outputs the information about start of the image forming to the CTL 10C when starting the image forming. At this time, the CTL 10C outputs the information about the image to be formed to a line memory 50*m* of the storage unit 50 and temporarily stores the information about the image to be formed. The CTL 10C outputs the information about the image forming to the image forming unit 20, on the basis of the information about start of the image forming output from the print job management part 10P.

The image forming unit 20 converts the information about the image to be formed to an image forming signal (an irradiation blink signal, an irradiation direction signal and the like to be input to an exposure device of the station 20ST). When forming the image, the image forming unit 20 transfers overlappingly toner images of each color onto the surface of the recording medium by means of stations 20ST for each color, so that a color image is formed on the recording medium.

When calibrating the image forming operation, the image forming unit 20 firstly generates information about alignment patterns by the pattern generating part 20*p*. Next, the image forming unit 20 outputs the generated information about alignment patterns to stations 20ST of respective colors via each skew correction part 20*s* and each data conversion part 20*d*. At this time, the image forming unit 20 forms alignment patterns for respective colors on respective surfaces of respective photosensitive drums in respective color stations 20ST.

The detail operation of the skew correction part 20*s* and the data conversion part 20*d* will be described in the following Example 2.

Next, the image forming unit 20 transfers overlappingly alignment patterns on respective surfaces of respective photosensitive drums for respective colors onto the carry belt 41 to form a calibration image on the carry belt 41. Next, the image forming unit 20 detects the positional information of alignment patterns of respective colors in the calibration image by the reading part 20*r* and calculates information about misregistration.

Then, the image forming apparatus calibrates the image forming operation, on the basis of the calculated information about misregistration. The detail operation of calibrating the image forming will be described in the following (Operation of Calibrating Image Forming).

(Image Forming Operation)

Figure 3:
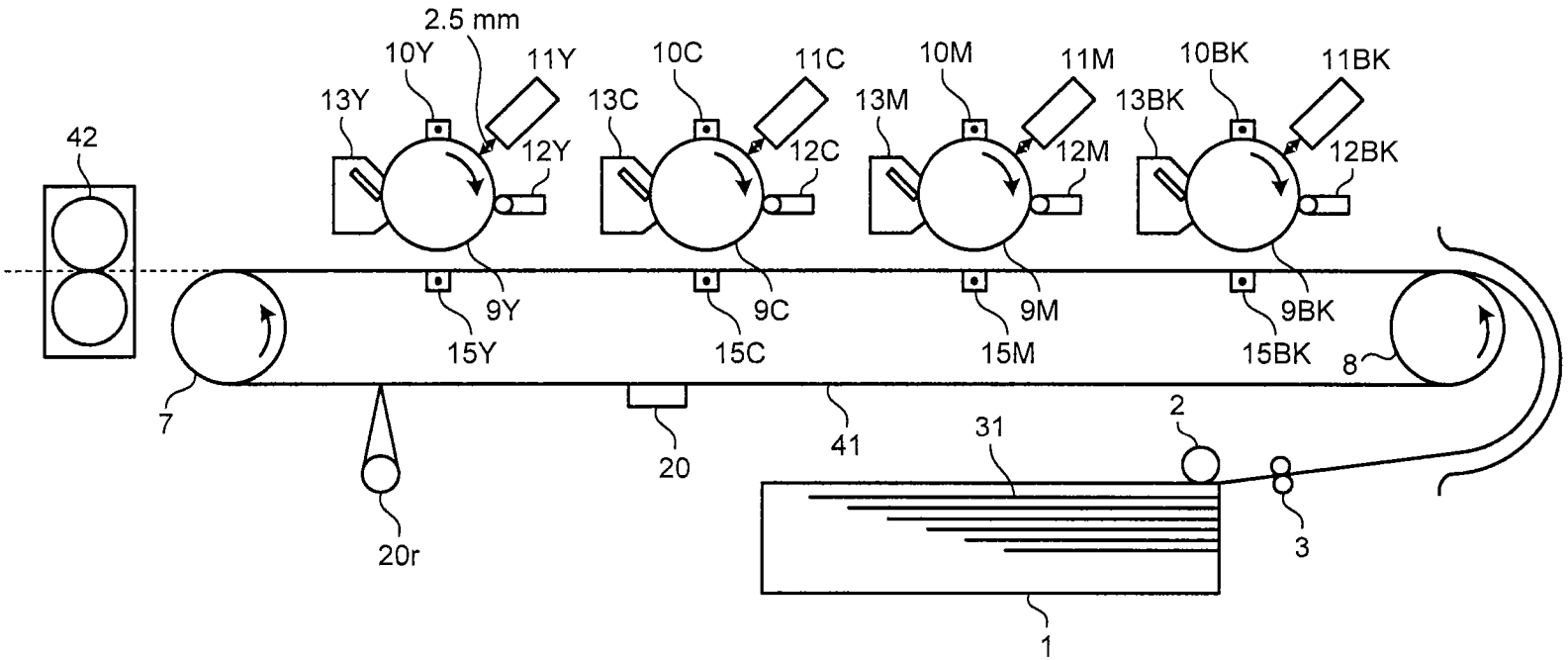
FIG. 3 is a schematic side view of an image forming apparatus.

The operation of forming an image on the recording medium in the image forming apparatus is now explained with reference to FIG. 3. FIG. 3 is a side view illustrating main parts of the image forming apparatus according to the present embodiment. In FIG. 3, the image forming apparatus includes four stations for four colors: black (BK); yellow (Y);

cyan (C); and magenta (M). The image forming apparatus may further include stations for other colors such as green (G) and red (R).

When forming an image, the image forming apparatus firstly charges each surface of photosensitive drums (9BK, 9M, 9C, and 9Y) of stations for respective colors by chargers (10BK, 10M, 10C, and 10Y). The image forming apparatus irradiates photosensitive drums (9BK and so on) with irradiation light by exposure devices (11BK, 11M, 11C, 11Y) on the basis of the information about the image forming, while rotating the photosensitive drums (9BK and so on). Thereby, the image forming apparatus forms electrostatic latent images for respective colors on each surface of photosensitive drums (9BK and so on) for respective colors.

The image forming apparatus can use an LEDA (Light Emitting Diode Array) as the exposure device.

Next, the image forming apparatus visualizes electrostatic latent images on each surface of photosensitive drums (9BK and so on) by means of developing devices (12BK, 12M, 12C, and 12Y), so that toner images for respective colors are formed on photosensitive drums (9BK and so on), respectively. At this time, the image forming apparatus supplies the recording medium 31 from the supply tray 1 by means of the supply roller 2 and the separation rollers 3. The image forming apparatus sends the recording medium 31 in between each photosensitive drum (9BK and so on) and the carry belt 41, with timing when toner images on respective photosensitive drums (9BK and so on) face respective transferring devices (15BK, 15M, 15C, and 15Y).

At this time, the image forming apparatus transfers toner images for respective colors formed on photosensitive drums (9BK and so on) for respective colors sequentially onto a surface of the recording medium 31 by transferring devices (15BK and so on). Thereby, the image forming apparatus forms a color image on the recording medium by overlappingly transferring toner images for respective colors onto the surface of the recording medium 31.

Then, by means of the carry belt 41 and the like, the image forming apparatus sends the recording medium 31 on which the image has been formed to a fixing device 42 where the image (toner, ink and so on) on the recording medium are fixed. Then, the image forming apparatus ejects the recording medium 31 on which the color image has been formed to an ejection tray. The image forming apparatus neutralizes each surface of photosensitive drums (9BK and so on) by means of neutralizing devices (13BK and so on), for preparing an operation for the next image forming.

Thus, the image forming apparatus completes the operation of forming the image on the recording medium.

(Operation of Calibrating Image Forming)

Figure 4:
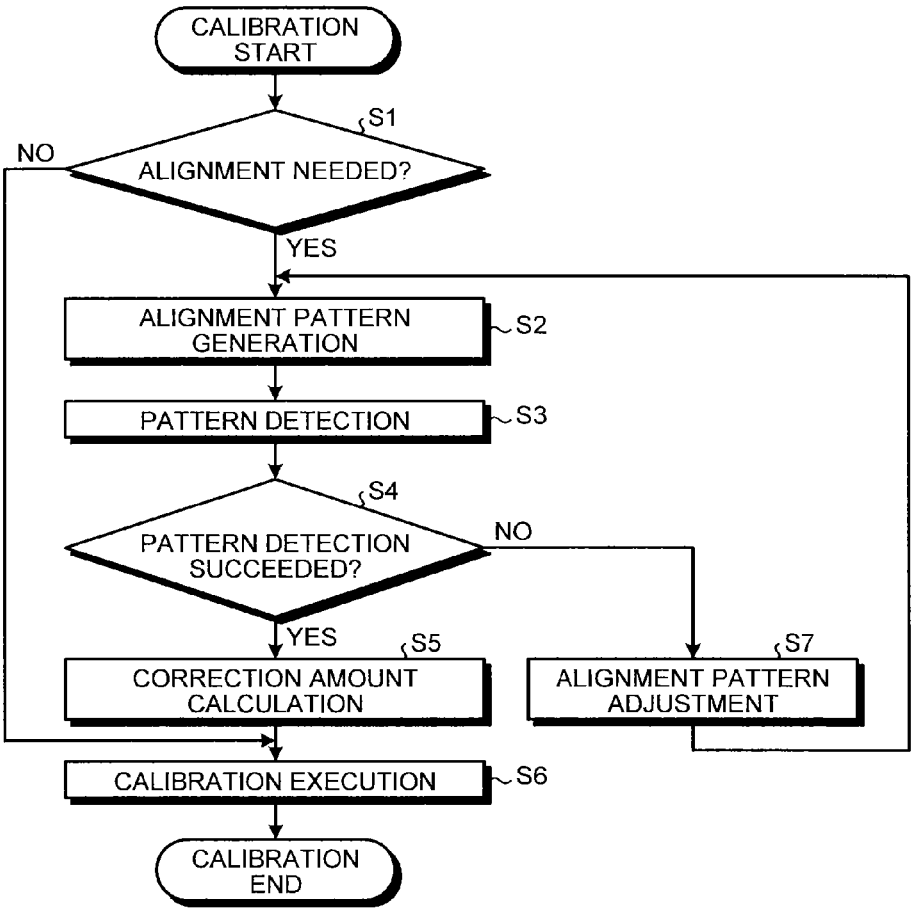
FIG. 4 is a flow chart illustrating an example of operation of an image forming apparatus.
Figure 5:
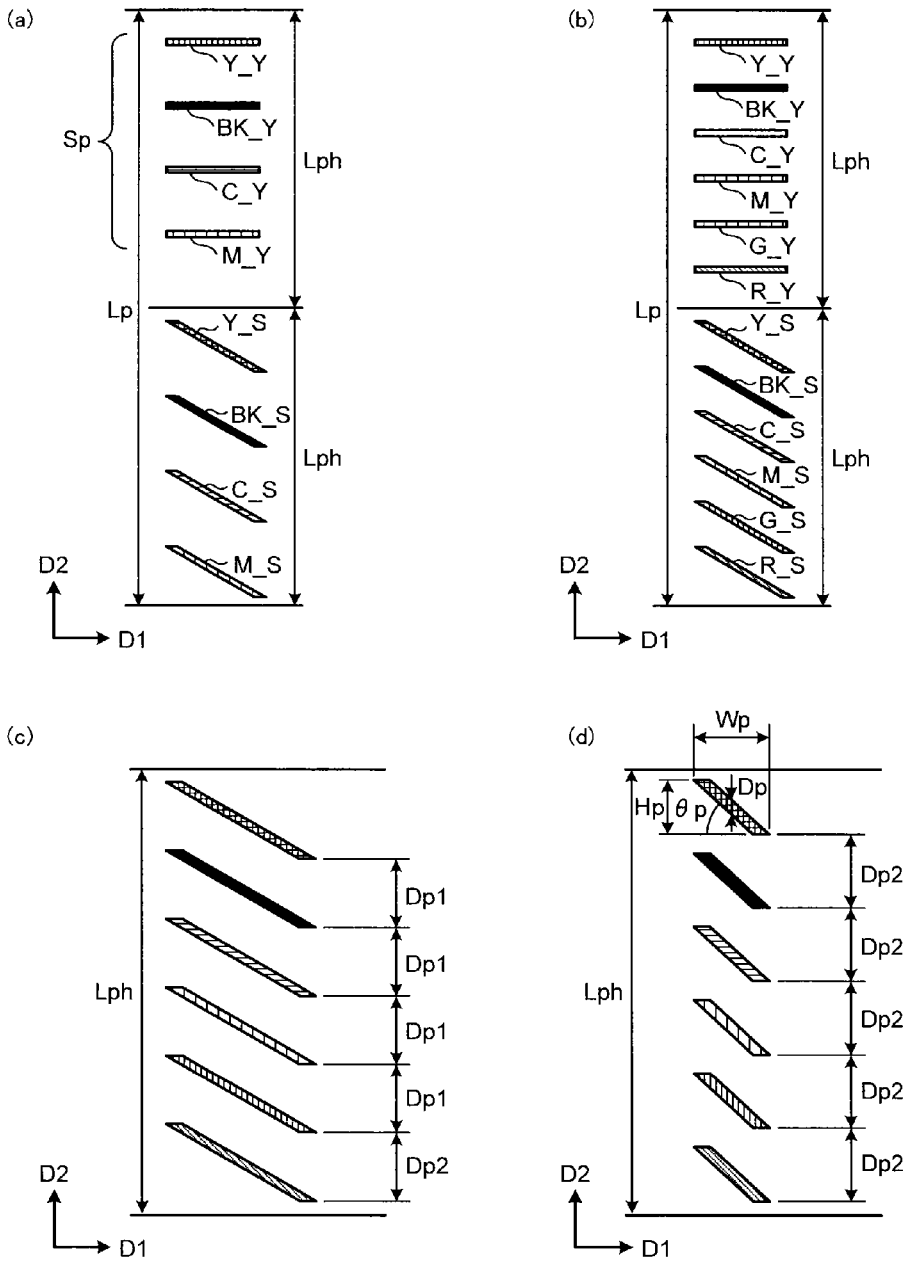
FIG. 5 is a view illustrating examples of calibration images.

The operation of calibrating the image forming in the image forming apparatus is now described, with reference to FIG. 4 and FIG. 5.

FIG. 4 is a flow chart illustrating an operation of the image forming apparatus. FIG. 5 (*a*) illustrates examples of alignment patterns for a calibration image when four colors are used. FIG. 5 (*b*) illustrates examples of alignment patterns for a calibration image when six colors are used. FIG. 5 (*c*) illustrates examples of slant line patterns in alignment patterns for six colors. FIG. 5 (*d*) illustrates examples of modified slant line patterns in alignment patterns for six colors.

In FIG. 4, the image forming apparatus firstly judges at Step S1 whether a calibration for the operation of forming an image is needed prior to performing the operation of forming the image on the basis of the information about the image forming input from the I/F unit. Specifically, the image forming apparatus judges through the control unit or the like whether the calibration is required on the basis of image type (low image quality, standard image quality or high image quality, etc.) of the image to be formed, the number of stations to be used (monochrome, four colors, or six colors, etc.), elapsed time from a time when the previous calibration is executed, and so on. Furthermore, the image forming apparatus can judge whether the calibration is required on the basis of power on/off status of the image forming apparatus and other information about the operation status of the image forming apparatus stored in the storage unit.

Thus, if the calibration for the operation of forming the image is required, the process goes to Step S2. Otherwise, the process goes to Step S6.

At Step S2, on the basis of the information about the image forming and the information about the pattern generating (will be described at Step S7), the image forming apparatus generates the information about alignment patterns through the pattern generation part of the image forming unit. Next, on the basis of the information about alignment patterns, the image forming apparatus forms a calibration image including a plurality of alignment patterns on the carry belt through stations for respective colors of the image forming unit.

The shape and number of alignment patterns for the calibration image can be changed depending on the number of stations to be calibrated. Therefore, the image forming apparatus may form the calibration image only by the station for color to be used for forming the image. With reference to FIG. 5(*a*) and FIG. 5(*b*), the calibration image is explained specifically.

FIG. 5(*a*) illustrates an example of calibration image to be used for the calibration before the image forming, in a case that four stations for four colors are used to form the image. The symbol Lp in the figure means a perimeter of a circular cross section of a photosensitive drum (a travel distance of the carry belt in the carry direction (the sub-scanning direction D2) corresponding to one round of the photosensitive drum). Hereinafter, the symbol Lp refers to one cycle length of the photosensitive drum.

It is understood from FIG. 5(*a*) that the image forming apparatus can form a pattern group Sp made of four horizontal linear alignment patterns (BK_Y, Y_Y, C_Y, and M_Y) extending orthogonally to the sub-scanning direction D2 when calibrating. The image forming apparatus can also form a pattern group made of four diagonal linear alignment patterns (BK_S, Y_S, C_S, and M_S) slanted by a predetermined angle relative to the sub-scanning direction D2. Therefore, the image forming apparatus can form the calibration image including the pattern group Sp made of four horizontal linear alignment patterns (BK_Y and so on) and the pattern group made of four diagonal linear alignment patterns (BK_S and so on).

The length of the pattern group Sp made of horizontal linear alignment patterns (BK_Y and so on) in the sub-scanning direction and the length of the pattern group made of diagonal linear alignment patterns (BK_S and so on) can be defined as a half of one cycle length of the photosensitive drum, respectively. Thereby, the calibration image including horizontal linear alignment patterns and diagonal linear alignment patterns (total 8 patterns) has a length corresponding to one cycle length of the photosensitive drum. Furthermore, the image forming apparatus can define the length of the pattern group in the sub-scanning direction as a length obtained by multiplying 1/N by the perimeter of the photosensitive drum. In this case, N is a natural number starting from 1.

On the other hand, FIG. 5(*b*) illustrates an example of calibration image in a case that six stations for six colors are used to form the image. In this case, the image forming apparatus can form the calibration image including six horizontal linear alignment patterns (BK_Y and so on) extending orthogonally to the sub-scanning direction D2 and six diagonal linear alignment patterns (BK_S and so on) slanted by a predetermined angle relative to the main scanning direction D1. In this case, the length of pattern groups including horizontal linear patterns and diagonal linear patterns (total 12 patterns) corresponds to one cycle length of the photosensitive drum.

Thereby, an interval between adjacent alignment patterns becomes shorter in the case of FIG. 5(*b*) than in the case of FIG. 5(*a*). Namely, if the number of colors to be used for forming an image increases, the number of stations to be calibrated increases and the number of alignment patterns increases. Thereby, the interval between adjacent alignment patterns becomes shorter when the number of colors increases.

Thus, after completing the operation of forming the calibration image made of a plurality of alignment patterns on the carry belt, the process in the image forming apparatus goes to Step S3.

Next, at Step S3, the image forming apparatus detects positional information of alignment patterns for respective colors in the calibration image formed on the carry belt through the read part (20*r* in FIG. 1 and FIG. 3) of the image forming unit. Specifically, the image forming apparatus irradiates a surface of the carry belt with an irradiation light and detects the reflected light therefrom.

If any alignment pattern is formed on the carry belt, the intensity of the reflected light decreases correspondingly to the alignment pattern. Thereby, the image forming apparatus can detect the positional information of the alignment pattern by detecting a reduced amount of the intensity of the reflected light corresponding to the alignment pattern. Incidentally, the positional information of the alignment pattern may be detected by irradiating the carry belt with the irradiation light and detecting the transmitted light.

Thus, after completing the detection of the positional information of alignment patterns for respective colors in the calibration image formed on the carry belt, the process in the image forming apparatus goes to Step S4.

At Step S4, the image forming apparatus judges whether the positional information of alignment patterns formed on the carry belt is detected. Specifically, the image forming apparatus can compare the number of alignment patterns generated by the pattern generation part of the image forming unit with the number of alignment patterns detected by the read part of the image forming unit and judge whether both numbers are the same or different. Alternatively, the image forming apparatus can compare the interval between the adjacent alignment patterns generated by the pattern generation unit of the image forming unit with the interval between the adjacent alignment patterns detected by the read part of the image forming unit and judge whether a difference between both intervals is in a predetermined acceptable range.

The predetermined acceptable range may be defined as a value corresponding to a shape of alignment patterns in the calibration image. The predetermined acceptable range may be also defined as a value determined in advance through a mathematical calculation, an experiment and so on.

Thus, if the image forming apparatus succeeds in detecting the positional information of alignment patterns for respective colors formed on the carry belt, the process goes to Step S5. Otherwise, the process goes to Step S7.

At Step S5, on the basis of the positional information detected at Step S4, the image forming apparatus calculates the information about the misregistration required for calibrating the operation of forming the image. On the basis of the calculated information about the misregistration, the image forming apparatus also calculates a correction amount required for calibrating the operation of forming the image. Specifically, on the basis of the detected positional information, the image forming apparatus calculates the information about misregistration such as (1) skew, (2) sub-scanning misregistration, (3) main scanning misregistration, (4) mismagnification, and so on.

The (1) skew means that each color position to be formed deviates obliquely because of the parallelism error of photosensitive drums or the like. The (2) sub-scanning misregistration means that each color position to be formed deviates to a carry direction of the recording medium (the sub-scanning direction) because of inter-axis error among photosensitive drums, timing error in writing, and so on. The (3) main scanning misregistration means that each color to be formed deviates to a writing direction (the main scanning direction) because of installation error of optical system such as mirror in the exposure device of the image forming unit, timing error in writing, and so on. The (4) mismagnification means that each color to be formed deviates so that lengths of scanning lines (magnification of the image to be formed) become different among colors because of installation error of optical system of the image forming unit, timing error in writing, and so on.

Incidentally, the aforementioned deviations (1) to (4) may reappear because of the replacement of each unit in the image forming apparatus, even if these deviations are adjusted when the apparatus is manufactured. Furthermore, these deviations may appear because of thermal expansion of each unit. Thereby, there is a need to perform or execute the calibration of the misregistration for a short time, for example when the image forming is started and during the image forming.

In the present embodiment, on the basis of the calculated information about the misregistration, the image forming apparatus performs a predetermined arithmetic processing and thereby calculates a correction amount for correcting the deviations (1) to (4).

Specifically, in the image forming apparatus, with regard to the (1) skew correction, a correction amount to correct the tilt of a deflection mirror in the exposure device or the tilt of the exposure device itself and so on by an actuator can be calculated on the basis of the information about the misregistration. With regard to the (2) sub-scanning misregistration correction, a correction amount to correct the writing timing in the sub-scanning direction, a plane phase of the optical system and so on can be calculated on the basis of the information about the misregistration. With regard to the (3) main scanning misregistration correction, a correction amount to correct the writing timing in the main scanning direction D1 and so on can be calculated on the basis of the information about the misregistration. With regard to the (4) mismagnification correction, a correction amount to correct the writing speed and so on can be calculated on the basis of the information about the misregistration.

Thus, the image forming apparatus calculates the information about the misregistration. On the basis of the calculated information about the misregistration, the image forming apparatus calculates correction amounts required for calibrating the operation of forming the image. Then, the process goes to Step S6.

At Step S6, the image forming apparatus prepares the operation of forming the image on the recording medium by using the calculated correction amounts. Then, the image forming apparatus terminates the operation of calibrating the image forming.

On the other hand, at Step S7, in order to perform the recalibration, the image forming apparatus calculates the information about the pattern generation required for the pattern generation part to change the alignment patterns, on the basis of the positional information detected at Step S3. At this point, the image forming apparatus can calculate the information about the pattern generation including without limitation the interval between adjacent alignment patterns, the shape (angle, width) and density of the alignment patterns, the number of stations to be calibrated, and the information about any station which cannot be detected. With reference to FIG. 5(*c*) and FIG. 5(*d*), the concrete explanation will be given.

FIG. 5(*c*) illustrates examples of diagonal linear patters in six alignment patterns for six colors. FIG. 5(*d*) illustrates examples of diagonal linear patterns modified to perform the recalibration in six alignment patterns for six colors.

In FIG. 5(*c*), the interval Dp1 between adjacent alignment patterns in the calibration image becomes shorter than in the case of forming four alignment patterns for four colors (FIG. 5(*a*)). Thereby, the image forming apparatus may fail to detect accurately the positional information of respective alignment patterns in the calibration image. At this time, the image forming apparatus can change the shape (angle, width and so on) of alignment patterns as illustrated in FIG. 5(*d*), so that the interval Dp2 between adjacent alignment patters becomes longer.

Furthermore, the image forming apparatus perform the calibration in two batches. Namely, the image forming apparatus can firstly calibrate three stations for selected three colors, and then calibrate station for the remaining three colors. Furthermore, for performing the recalibration, the image forming apparatus can calculate the information about the pattern generation on the basis of the number of stations excluding stations for colors failed to be detected. Alternatively, for performing the recalibration, the image forming apparatus can calculate the information about the pattern generation on the basis of the number of stations excluding stations whose frequency of use is low in forming the image.

Thus, the image forming apparatus according to the present embodiment can calibrate the operation of forming the image by changing alignment patters used for the calibration image, or by changing the number of stations to be calibrated so that the calibration is performed in separated batches, even in a case that multiple stations for multiple colors are to be calibrated, or even in a case that a specific station does not function properly because of lack of ink or the like.

Example 1

The present invention is now explained through Examples of the image forming apparatus.

(Configuration of Image Forming Apparatus, Function of Image Forming Apparatus and Operation of Forming Image)

The basic configuration of an image forming apparatus of this Example is illustrated in FIG. 1. In FIG. 1, the image forming apparatus 200 of this Example has the same configuration as the image forming apparatus 100 explained in the aforementioned embodiment. Therefore, the redundant explanation is omitted.

The function of the image forming apparatus and the operation of forming the image are the same as the function of the image forming apparatus and the operation of forming the image explained in the aforementioned embodiment. Therefore, the redundant explanation is omitted.

(Operation of Calibrating Image Forming)

The operation of calibrating the image forming in the image forming apparatus of this Example is now explained with reference to FIG. 4 and FIG. 5. The operation of calibrating the image forming is basically the same as the operation of calibrating the image forming explained in the embodiment (FIG. 4). Therefore, only the different part (changing the shape of alignment patterns) is explained.

At step S7 in FIG. 4, in order to perform the recalibration, the image forming apparatus calculates the information about the pattern generation required for the pattern generation part to change alignment patterns, on the basis of the positional information detected at Step S3. At this point, in order to widen the interval between adjacent diagonal alignment patters, the image forming apparatus can calculate parameters to change the angle, the width in the main scanning direction, the thickness in the sub-scanning direction of each diagonal linear pattern, and the number of patterns.

Specifically, on the basis of the following formula, the image forming apparatus can change the shapes of diagonal linear patterns illustrated in FIG. 5(*c*) to the shapes of diagonal linear patterns illustrated in FIG. 5(*d*).

$$Dp2=(Lph-Hp-Dp\times(N-1))/(N-1)$$

In the above formula, Dp2 means the interval between adjacent diagonal linear patterns, Lph means a length of the pattern group made of a plurality of diagonal linear patterns in the sub-scanning direction, Hp means a length of a diagonal linear pattern in the sub-scanning direction, Dp means a thickness of a diagonal linear pattern in the sub-scanning direction, and N means the number of diagonal linear patterns (six in this Example).

At this time, the length Hp of a diagonal linear pattern in the sub-scanning direction in the above formula can be calculated according to the following formula.

$$Hp=Wp\times\tan\theta p$$

In the above formula, Wp means a width of a diagonal linear pattern in the main scanning direction, and θp means an angle of a diagonal linear pattern relative to the main scanning direction.

According to the above formulae, the image forming apparatus can change the interval Dp2 between adjacent patterns by changing the thickness Dp of a diagonal linear pattern in the sub-scanning direction, the number N of diagonal linear patterns, the width Wp of a diagonal linear pattern in the main scanning direction, and the angle θp of a diagonal linear pattern relative to the main scanning direction. In a case that the interval between adjacent diagonal linear patterns is adjusted by reducing the thickness Dp of a diagonal linear pattern in the sub-scanning direction (by thinning the diagonal linear pattern), the image forming apparatus can increase the density of the diagonal linear pattern, in order to secure the accuracy in the detection. Furthermore, the image forming apparatus may change gradually or stepwisely the shapes of diagonal linear patterns by using a value determined in advance through an experiment or a mathematical calculation, in order to select and determine appropriate shapes of diagonal linear patterns, so that a plurality of calibrations are performed.

Example 2

The present invention is now explained through Example of the image forming apparatus.

(Configuration of Image Forming Apparatus and Operation of Forming Image)

The basic configuration of the image forming apparatus according to this Example is illustrated in FIG. 1. In FIG. 1, the image forming apparatus 300 of this Example has the same configuration as the image forming apparatus 100 explained in the aforementioned embodiment. Therefore, the redundant explanation is omitted.

The operation of forming the image in this Example is the same as the operation of forming the image explained in the aforementioned embodiment. Therefore, the redundant explanation is omitted.

(Function of Image Forming Apparatus)

The function of the image forming apparatus in this Example is explained with reference to FIG. 2. The function of the image forming apparatus in this Example is basically the same as the function of the image forming apparatus explained in the aforementioned embodiment. Therefore, only the different part (the skew correction part and the data conversion part) is explained.

In FIG. 2, the skew correction part 20*s* delays the information about the alignment patterns generated by the pattern generation part 20*p* by a predetermined skew amount and then outputs the delayed information to the data conversion part 20*d*. Thereby, the skew correction part 20*s* can change the interval between adjacent alignment patterns and the angle of the diagonal linear pattern in the alignment patterns relative to the main scanning direction.

The predetermined skew amount may be a value corresponding to a shape of an alignment pattern in the calibration image. Also, the predetermined skew amount may be a value determined through a mathematical calculation and an experiment or the like.

Specifically, the skew correction part 20*s* converts the information about alignment patterns (hereinafter, called input data in this paragraph) output from the pattern generation part 20*p* into a predetermined format corresponding to the operation of the exposure part of the station. At this time, if the input data is 4 bit data in 600 dpi, the skew correction part 20*s* can convert $0^{th}$ bit of the input data so as to map it to a pixel (n, m) of the output data. The skew correction part 20*s* can also convert $1^{st}$ bit, $2^{nd}$ bit and $3^{rd}$ bit of the input data so as to map them respectively to pixels (n+1, m), (n, m+1) and (n+1, m+1) of the output data. Furthermore, if the input data is 1 bit data in 1200 dpi, the skew correction part 20*s* can convert $0^{th}$ bit, $1^{st}$ bit, $2^{nd}$ bit and $3^{rd}$ bit of the input data so as to map them respectively to pixels (n, m), (n+1, m), (n+2, m) and (n+3, m).

In the above explanation, n means a coordinate corresponding to the main scanning direction when forming the image, and m means a coordinate corresponding to the sub-scanning direction.

The data conversion part 20*d* converts the information about alignment patterns output from the skew correction part 20*s* into image forming signals (the irradiation blink signal, the irradiation direction signal and the like to be input to the exposure device) corresponding to respective stations 20ST for respective colors. The data conversion part 20*d* can convert the information about alignment patterns into the information forming signals, on the basis of the image quality of the calibration image to be formed and the accuracy in detecting the alignment patterns.

The image forming apparatus can determine the image quality of the calibration image and the accuracy in detecting the alignment patterns, on the basis of the information about the image forming input from the I/F unit 60. The image forming apparatus can also define the image quality of the calibration image and the accuracy in detecting the alignment patterns as a value determined in advance through a mathematical calculation and an experiment or the like.

(Operation of Calibrating Image Forming)

The operation of calibrating the image forming in the image forming apparatus of this Example is now explained with reference to FIG. 6. The operation of calibrating the image forming in this Example is basically the same as the operation of calibrating the image forming explained in the aforementioned embodiment (FIG. 4). Therefore, only a different part (changing the shapes of alignment patterns) is explained.

Figure 6:
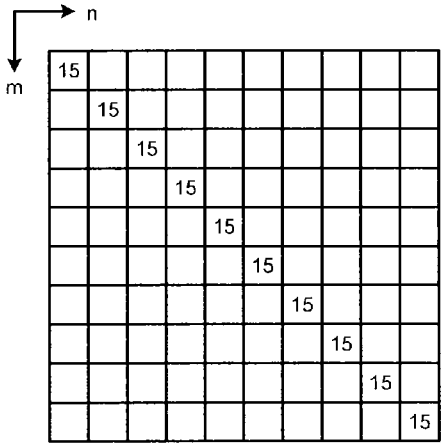
FIG. 6 is a view illustrating an example of operation of data conversion part of Example 2.
Figure 6:
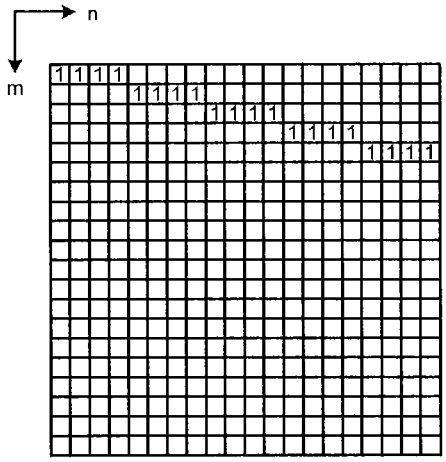
Figure 6:
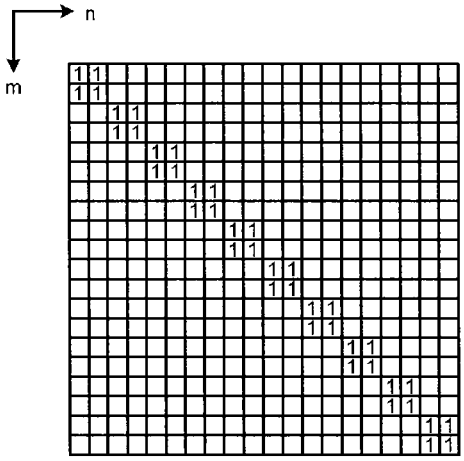

FIG. 6(*a*) illustrates the information about alignment patterns (diagonal linear pattern) generated by the pattern generation part in an array corresponding to coordinates (n, m) of pixels for forming the image. The n direction in the figure corresponds to the main scanning direction (D1 direction in FIG. 5). The m direction in the figure corresponds to the sub-scanning direction (D2 direction in FIG. 5).

In FIG. 6(*a*), the pattern generation part generates the information of diagonal linear pattern having 45 degrees relative to the main scanning direction.

Next, in FIG. 6(*b*), the data conversion part 20*d* can convert the information of diagonal linear pattern (FIG. 6(*a*)) into the information (the irradiation blink signal, the irradiation direction signal and the like to be input to the exposure device) in an array corresponding to respective stations 20ST for respective colors in binary mode of 1200 dpi. In FIG. 6(*c*), the data conversion part 20*d* can convert the information of diagonal linear pattern into the information in an array corresponding to respective stations 20ST for respective colors in hexadecimal mode of 600 dpi.

In the case of binary mode of 1200 dpi illustrated in FIG. 6(*b*), the angle of the diagonal linear pattern relative to the main scanning direction is approximately 14 degrees. On the other hand, in the case of hexadecimal mode of 1200 dpi illustrated in FIG. 6(*c*), the angle of the diagonal linear pattern relative to the main scanning direction is approximately 45 degrees.

Thus, the data conversion part 20*d* of the image forming apparatus can convert the information about one alignment pattern (diagonal linear pattern) generated by the pattern generation part into two kinds of diagonal linear pattern information. Thereby, the throughput of the pattern generation part can be reduced, and the image forming apparatus can be smaller, lighter and simplified.

According to the image forming apparatus of the present invention, the misregistration can be detected even if the number of the calibration patterns required for detecting the misregistration increases.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus capable of transferring a plurality of color component images onto a surface of a recording medium to form an image on the recording medium, the image forming apparatus comprising:

a pattern generator to generate information about an alignment pattern to be used for a calibration of an image forming;

a plurality of stations each including a photosensitive drum to form an alignment pattern corresponding to each of a plurality of color components onto a carry belt or the recording medium; and at least one detector to detect a plurality of alignment patterns formed by the plurality of stations, wherein the pattern generator generates the information about the alignment pattern on the basis of the number of stations for one or more colors to be used for the image forming, the plurality of stations generate a pattern group including the plurality of alignment patterns on the basis of the information about the alignment pattern, wherein the pattern generator changes the information about the alignment pattern, in a case that the at least one detector fails to detect any of the plurality of alignment patterns formed by the plurality of stations, the changes of the information including at least one change to a horizontal linear alignment pattern or a diagonal linear alignment pattern of the plurality of alignment patterns, and wherein the plurality of stations form the plurality of alignment patterns on the basis of the changed information about the alignment pattern.

2. The image forming apparatus according to claim 1, wherein the information about the alignment pattern includes information about a thickness of an alignment pattern to be formed by a station in a sub-scanning direction.

3. The image forming apparatus according to claim 1, wherein the information about the alignment pattern includes information about a density of an alignment pattern to be formed by a station.

4. The image forming apparatus according to claim 1, wherein the information about the alignment pattern includes information about a width of an alignment pattern to be formed by a station in a main scanning direction.

5. The image forming apparatus according to claim 1, wherein the information about the alignment pattern includes information about an angle of an alignment pattern to be formed by a station relative to a main scanning direction.

6. The image forming apparatus according to claim 5, further comprising a data conversion part to convert the information about the alignment pattern into information in an array corresponding to a position in the main scanning direction and a position in the sub-scanning direction, wherein the data conversion part converts the information about the angle, and the station forms the alignment pattern on the basis of the converted information about the angle.

7. The image forming apparatus according to claim 1, wherein the pattern generator changes the information about the alignment pattern on the basis of a reduced number of stations.

8. The image forming apparatus according to claim 7, wherein the pattern generator reduces the number of stations corresponding to any alignment pattern which is not detected by the at least one detector.

9. The image forming apparatus according to claim 7, wherein the pattern generator reduces the number of stations whose frequency of use is low in the image forming.

10. The image forming apparatus according to claim 1, wherein a length of the pattern group in a sub-scanning direction is a length obtained by multiplying 1/N by a perimeter of the photosensitive drum, and wherein N is a natural number starting from 1.

11. An image forming apparatus capable of transferring a plurality of color component images onto a surface of a recording medium to form an image on the recording medium, the image forming apparatus comprising:

a pattern generator to generate information about an alignment pattern to be used for a calibration of an image forming;

a plurality of stations each including a photosensitive drum to form an alignment pattern corresponding to each of a plurality of color components onto a carry belt or the recording medium;

at least one detector to detect a plurality of alignment patterns formed by the plurality of stations; and wherein the pattern generator generates the information about the alignment pattern on the basis of the number of stations for one or more colors to be used for the image forming, the plurality of stations generate a pattern group including the plurality of alignment patterns on the basis of the information about the alignment pattern, wherein a length of the pattern group in a sub-scanning direction is a length obtained by multiplying 1/N by a perimeter of the photosensitive drum, with N being a natural number starting from 1;

wherein the pattern generator changes the information about the alignment pattern to be used for the calibration of the image forming, in a case that at least one detector fails to detect any of the plurality of alignment patterns formed by the plurality of stations, wherein the plurality of stations form the plurality of alignment patterns on the basis of the changed information about the alignment pattern, wherein the pattern generator changes the information about the alignment pattern on the basis of a reduced number of stations, and wherein the pattern generator reduces the number of stations whose frequency of use is low in the image forming.

12. The image forming apparatus according to claim 1, wherein the at least one change to the horizontal linear alignment pattern or the diagonal linear alignment pattern includes changing a thickness of the horizontal linear alignment pattern or the diagonal linear alignment pattern of the plurality of alignment patterns.

13. The image forming apparatus according to claim 1, wherein the at least one change includes changing a density of the horizontal linear alignment pattern or the diagonal linear alignment pattern of the plurality of alignment patterns.

14. The image forming apparatus according to claim 1, wherein the at least one change includes changing a width of the horizontal linear alignment pattern or the diagonal linear alignment pattern of the plurality of alignment patterns.

15. The image forming apparatus according to claim 1, wherein the at least one change includes changing an angle of the horizontal linear alignment pattern or the diagonal linear alignment pattern of the plurality of alignment patterns.

16. The image forming apparatus according to claim 1, wherein the at least one change includes changing an angle, a width, and a thickness of the horizontal linear alignment pattern or the diagonal linear alignment pattern of the plurality of alignment patterns.

* * * * *